US007249995B2

(12) United States Patent
Tanoue et al.

(10) Patent No.: US 7,249,995 B2
(45) Date of Patent: Jul. 31, 2007

(54) APPARATUS AND METHOD FOR FEEDING SLURRY

(75) Inventors: Akihiro Tanoue, Toyama (JP); Yoshiharu Hidaka, Toyama (JP); Shin Hashimoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 54 days.

(21) Appl. No.: 10/865,822

(22) Filed: Jun. 14, 2004

(65) Prior Publication Data

US 2004/0242127 A1 Dec. 2, 2004

Related U.S. Application Data

(62) Division of application No. 09/982,064, filed on Oct. 19, 2001, now Pat. No. 6,790,127, which is a division of application No. 09/447,573, filed on Nov. 23, 1999, now Pat. No. 6,319,099.

(30) Foreign Application Priority Data

Nov. 24, 1998 (JP) ..... 10-332634

(51) Int. Cl.
*B24C 7/00* (2006.01)

(52) U.S. Cl. ..... 451/99; 451/60

(58) Field of Classification Search ..... 451/60, 451/99

See application file for complete search history.

(56) References Cited

U.S. PATENT DOCUMENTS 4,678,119 A * 7/1987 Doyle ..... 239/9
4,952,099 A 8/1990 Drobadenko et al.
5,603,654 A * 2/1997 Hayashi ..... 451/36
5,664,990 A * 9/1997 Adams et al. ..... 451/60
5,750,440 A * 5/1998 Vanell et al. ..... 438/692
5,885,134 A * 3/1999 Shibata et al. ..... 451/41
5,922,620 A * 7/1999 Shimomura et al. ..... 438/693
5,957,759 A * 9/1999 Cardenas et al. ..... 451/60
6,006,738 A 12/1999 Itoh et al.

(Continued)

FOREIGN PATENT DOCUMENTS

JP 57-059052 4/1982

(Continued)

OTHER PUBLICATIONS

Notice of Reasons of Rejection, Patent Application No. 10-332634, Mailing Date: Jul. 30, 2002, Mailing No. 247483.

(Continued)

*Primary Examiner*—M. Rachuba
(74) *Attorney, Agent, or Firm*—Nixon Peabody LLP; Donald R. Studebaker

(57) ABSTRACT

A slurry feeding apparatus includes closed slurry bottle, piping, wet nitrogen generator, wet nitrogen supply pipe, suction and spray nozzles, temperature regulator, flow rate control valves, slurry delivery pump and controller for controlling the operation and flow rate of the slurry delivery pump. While a wafer is being polished by a CMP polisher, the controller continuously operates the pump. On the other hand, while the polisher is idling, the controller starts and stops the pump intermittently at regular intervals. No stirrer like a propeller is inserted into the slurry bottle, but the slurry is stirred up by spraying the slurry through the spray nozzle.

6 Claims, 10 Drawing Sheets

U.S. PATENT DOCUMENTS

| | | | | |
|---|---|---|---|---|
| 6,024,227 | A | 2/2000 | Bilodeau et al. | |
| 6,059,920 | A * | 5/2000 | Nojo et al. | 156/345.12 |
| 6,106,728 | A | 8/2000 | Iida et al. | |
| 6,200,202 | B1 | 3/2001 | Eastman et al. | |
| 6,203,412 | B1 * | 3/2001 | Quek | 451/60 |
| 6,306,020 | B1 | 10/2001 | Hed et al. | |
| 6,319,099 | B1 | 11/2001 | Tanoue et al. | |
| 6,338,671 | B1 | 1/2002 | Kawashima et al. | |
| 6,544,109 | B1 | 4/2003 | Moore | |
| 6,547,646 | B2 | 4/2003 | Eastman et al. | |
| 6,585,560 | B2 | 7/2003 | Tanoue et al. | |

FOREIGN PATENT DOCUMENTS

| | | |
|---|---|---|
| JP | 62-068276 | 3/1987 |
| JP | 62-188672 | 8/1987 |
| JP | 01-163056 | 11/1989 |
| JP | 03-208555 | 9/1991 |
| JP | 06-045300 | 2/1994 |
| JP | 07-251198 | 10/1995 |
| JP | 07-254579 | 10/1995 |
| JP | 08-142981 | 6/1996 |
| JP | 09-234669 | 9/1997 |
| JP | 09-285968 | 11/1997 |
| JP | 10-015822 | 1/1998 |
| JP | 10-235546 | 9/1998 |
| JP | 11-138439 | 5/1999 |
| JP | 11-165259 | 6/1999 |
| JP | 2000-158339 | 6/2000 |

OTHER PUBLICATIONS

Office Action issued by Japanese Patent Office dated Jan. 23, 2007 in corresponding Japanese Application No. 2003-378411.

Office Action issued by Japanese Patent Office dated Jan. 23, 2007 in corresponding Japanese Application No. 2003-378417.

* cited by examiner

APPARATUS AND METHOD FOR FEEDING SLURRY

This application is a divisional of Ser. No. 09/982,064, filed 19 Oct. 2001, now U.S. Pat. No. 6,790,127, which is a divisional of Ser. No. 09/447,573, filed 23 Nov. 1999, now U.S. Pat. No. 6,319,099.

BACKGROUND OF THE INVENTION

The present invention relates to slurry feeding apparatus and method for use in a chemical/mechanical polishing (CMP) process of a wafer.

In recent years, the surface of a semiconductor wafer is often planarized by a CMP technique to ensure sufficient uniformity for an interlevel dielectric film, for example, during the manufacturing process of transistors on the substrate. The CMP process is performed using a kind of slurry, where fumed or colloidal silica is dispersed as abrasive grains in an alkaline solution of ammonium, for example.

FIG. 8 illustrates a cross section of a known (polishing) slurry feeding apparatus F1 as disclosed in Japanese Laid-Open Publication No. 10-15822.

As shown in FIG. 8, the slurry feeding apparatus F1 includes tank 101, delivery pipe 102 with a pump 104, flow rate control valve 103, feeding nozzle 110 and stirrer 106. Polishing slurry 109 is stored in the tank 101 and delivered through the delivery pipe 102 from the tank 101 to a CMP polisher (not shown). The flow rate control valve 103 is provided in the middle of the pipe 102 downstream of the pump 104. The feeding nozzle 110 is attached to the end of the pipe 102 for dripping the slurry 109 onto a polishing pad (not shown) of the polisher. And the stirrer 106 with a propeller is used for stirring the slurry 109. A circulation pipe 105 is further provided as a branch from the delivery pipe 102 upstream of the valve 103 to circulate the slurry 109 by feeding the slurry 109 back to the tank 101 therethrough. A heater 107 is further provided on the bottom of the tank 101 to regulate the temperature of the slurry 109 within the tank 101. The temperature of the heater 107 is in turn regulated by a heater temperature controller 108. In polishing a wafer, the opening of the valve 103 is adjusted and a predetermined amount of the slurry 109 is sucked up from the tank 101 using the pump 104 and then dripped onto the polishing pad through the feeding nozzle 110. The remainder of the slurry 109 is recovered to the tank 101 through the circulation pipe 105. On the other hand, while the polishing process is not performed, the valve 103 is closed and all the slurry 109 is recovered to the tank 101, thereby circulating the slurry 109 without delivering it.

As for colloidal silica, the primary grains thereof have a tiny size of 20 to 30 nm. But in the polishing slurry 109, a certain number of primary silica grains coagulate to form secondary grains with a size of 100 to 200 nm. As for fumed silica on the other hand, the grain size thereof is 100 to 200 nm from the beginning (i.e., when they are prepared). Thus, it is generally believed that these secondary grains with a grain size of 100 to 200 nm actually contribute to the polishing process.

Nevertheless, if an excessive number of abrasive grains coagulate together to form grains with a size as large as about 500 nm or more, then micro-scratches are possibly made on the object being polished.

Thus, the conventional slurry feeding apparatus F1 always circulates the polishing slurry 109 and stirs the slurry 109 up with the propeller, thereby suppressing the sedimentation and coagulation of the abrasive grains in the slurry 109.

FIG. 10 illustrates a cross section of a coupling generally provided for the piping where the slurry flows in a conventional slurry feeding apparatus. By using couplings in various shapes for the corner or linear portions, piping can be formed in a complicated shape and the cross-sectional area of the piping and the overall size of the slurry feeding apparatus can be both reduced.

It is known that the excessively promoted coagulation of the abrasive grains (e.g., with a grain size of more than about 500 nm) not only causes micro-scratches on the object being polished but also decreases the polishing rate.

FIG. 9 is a graph illustrating, in comparison, respective polishing rates of Slurry 1 and 2 with mutually different concentrations of solid content (abrasive grains) in accordance with results of experiments carried out by the present inventors. As can be seen from FIG. 9, although the solid content concentration of Slurry 1 is only 1% lower than that of Slurry 2, the polishing rate attained by Slurry 1 is considerably lower than that attained by Slurry 2. Such a decrease in solid content concentration could result from the sedimentation of abrasive grains with an excessively increased size in the tank. Accordingly, it is critical to prevent the size of abrasive grains from increasing excessively in order to obtain an appropriate polishing rate.

To suppress the coagulation of abrasive grains, the conventional slurry feeding apparatus has the following drawbacks.

Firstly, the increase in size of abrasive grains in the slurry 109 cannot be suppressed sufficiently only by stirring the slurry 109 up using the stirrer 106 with a propeller as shown in FIG. 8.

Secondly, the slurry 109 is likely to form puddles here and there in the regions Rg of the coupling where two pipes of the piping are joined together in the slurry feeding apparatus F1. This is because there are many gaps and level differences between these pipes in the region Rg as shown in FIG. 10. As a result, the excessive coagulation of the abrasive grains is possibly promoted.

Thirdly, the solidified contents of the slurry 109 are likely to deposit on the inner walls of the tank 101 as the level of the slurry solution changes in the tank 101. And the solidified slurry 109 once deposited will collapse within the tank 101 to increase the size of the grains coagulated.

Since the size of the abrasive grains is excessively increased in this manner, the micro-scratches are made on the object being polished and the polishing rate thereof decreases or becomes inconstant.

SUMMARY OF THE INVENTION

An object of the present invention is reducing the number of micro-scratches made on the object being polished and attaining an intended polishing rate by suppressing the excessive increase in size of the abrasive grains. Exemplary measures include: improving slurry stirring and circulating methods; eliminating gaps and level differences from the inside of piping; and preventing the solidified slurry from being deposited on the inner walls of the tank.

A first exemplary slurry feeding apparatus according to the present invention is adapted to feed polishing slurry to a chemical/mechanical polisher. The apparatus includes: a container for storing the slurry therein; a first nozzle for sucking the slurry up from the container; a second nozzle for recovering the slurry back to the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; a pump, which is provided for at least one of the first and second pipes for making the slurry flow with a pressure applied; and control means for operating the pump continuously while the polisher is operating and intermittently while the polisher is idling.

According to the first apparatus, it is possible to minimize the number of excessively large-sized abrasive grains, which usually result from their collision in the slurry due to the pressure applied from a pump.

A second exemplary slurry feeding apparatus is also adapted to feed polishing slurry to a chemical/mechanical polisher. The apparatus includes: a container for storing the slurry therein; a first nozzle for sucking the slurry up from the container; a second nozzle for recovering the slurry back to the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; and a pump, which is provided for at least one of the first and second pipes for making the slurry flow with a pressure applied. The first nozzle sucks up portion of the slurry that is located higher than the bottom of the container by a predetermined distance or more.

According to the second apparatus, it is possible to prevent abrasive grains of an excessively large size, which are sedimented easily on the bottom of the container, from being sucked up through the first nozzle and then delivered to the CMP polisher.

In one embodiment of the present invention, the first nozzle preferably sucks up portion of the slurry that is located higher than the bottom of the container by 5 centimeters or more.

In another embodiment, the end of the first nozzle may be cut away obliquely with respect to the axis thereof.

In an alternate embodiment, the end of the first nozzle may be closed, and the side of the first nozzle may be provided with a plurality of openings for sucking the slurry up therethrough.

In another alternate embodiment, the apparatus may further include a mechanism for adjusting the level of the first nozzle at the end thereof.

A third exemplary slurry feeding apparatus according to the present invention is also adapted to feed polishing slurry to a chemical/mechanical polisher. The apparatus includes: a container for storing the slurry therein; a first nozzle for sucking the slurry up from the container; a second nozzle for spraying the slurry into the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; and a pump, which is provided for the second pipe for making the slurry flow with a pressure applied. The second nozzle sprays the slurry into the container from a position at a predetermined level over the bottom of the container.

According to the third apparatus, even if no stirrer such as a propeller is provided for the container, the slurry in the container can still be stirred up by being sprayed. Thus, it is possible to prevent the size of the abrasive grains from being increased overly due to the unwanted application of excessive energy from the propeller to the grains, for example.

In one embodiment of the present invention, the second nozzle may spray the slurry into the container from a position higher than the bottom of the container by 5 centimeters or less.

In an alternate embodiment, the second nozzle may have an opening with a reduced diameter at the end thereof. In such a case, the slurry can be sprayed at an increased velocity and therefore the slurry in the container can be stirred more effectively.

In another alternate embodiment, the apparatus may further include a mechanism for adjusting the level of the second nozzle at the end thereof.

In still another embodiment, a plurality of the second nozzles may be placed within the container.

A fourth exemplary slurry feeding apparatus according to the present invention is also adapted to feed polishing slurry to a chemical/mechanical polisher. The apparatus includes: a container for storing the slurry therein; a first nozzle for sucking the slurry up from the container; a second nozzle for recovering the slurry back to the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; and a pump, which is provided for at least one of the first and second pipes for making the slurry flow with a pressure applied. Each of the first and second pipes is provided with no coupling at any intermediate point thereof.

According to the fourth apparatus, level differences and gaps involved with a coupling can be eliminated from the circulation pipe of the slurry. Thus, it is possible to prevent the size of abrasive grains from being increased excessively due to the slurry puddles.

A fifth exemplary slurry feeding apparatus according to the present invention is also adapted to feed polishing slurry to a chemical/mechanical polisher. The apparatus includes: a container for storing the slurry therein; a first nozzle for sucking the slurry up from the container; a second nozzle for recovering the slurry back to the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; and a pump, which is provided for at least one of the first and second pipes for making the slurry flow with a pressure applied. The radius of curvature at a corner of the first and second pipes is 5 centimeter or more.

According to the fifth apparatus, the slurry puddles can be eliminated from the corners, thus preventing the size of abrasive grains from being increased excessively.

A sixth exemplary slurry feeding apparatus according to the present invention is also adapted to feed polishing slurry to a chemical/mechanical polisher. The apparatus includes: a hermetically sealed container for storing the slurry therein; a first nozzle for sucking the slurry up from the container; a second nozzle for recovering the slurry back to the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; a pump, which is provided for at least one of the first and second pipes for making the slurry flow with a pressure applied; and means for externally supplying a wet ambient gas.

According to the sixth apparatus, a wet ambient can be created within the container. Thus, even if the slurry solution in the container has changed its level, it is possible to prevent any solidified slurry from being formed on the inner walls of the container.

A seventh slurry feeding apparatus according to the present invention is also adapted to feed polishing slurry to a chemical/mechanical polisher. The apparatus includes: a container for storing the slurry therein; a first nozzle for sucking the slurry up from the container; a second nozzle for recovering the slurry back to the container; a third nozzle for dripping the slurry in the polisher; a first pipe, which is connected to the first and third nozzles for delivering the slurry to the polisher; a second pipe, which is connected to the second nozzle and the first pipe for bypassing at least part of the slurry flowing through the first pipe from the third nozzle and then recovering that part of the slurry back to the second nozzle; a control valve for regulating the flow rate of the slurry, which is now flowing through the first pipe and will be supplied to the third nozzle and the second pipe; a pump, which is provided for at least one of the first and second pipes for making the slurry flow with a pressure applied; and sampling boards, which are attached to the container for extracting the slurry from the container for sampling purposes.

According to the seventh apparatus, the state of the slurry can always be monitored. Thus, chemical/mechanical polishing can be performed constantly.

In one embodiment of the present invention, the sampling boards are preferably attached to the container at upper, intermediate and lower portions thereof.

A first exemplary method according to the present invention is adapted to feed polishing slurry to a chemical/mechanical polisher. According to the first method, while the polisher is operating, the slurry is continuously circulated by extracting and delivering part of the slurry from a container, where the slurry is stored, to the polisher and by recovering the remaining slurry, which has not been delivered to the polisher, back to the container. On the other hand, while the polisher is idling, the slurry is circulated intermittently by recovering all of the slurry extracted back to the container.

The same effects as those attained by the first slurry feeding apparatus are also attainable by the first method.

A second exemplary method according to the present invention is also adapted to feed polishing slurry to a chemical/mechanical polisher. The slurry delivered from a container to the polisher is located higher than the bottom of the container by a predetermined distance or more.

The same effects as those attained by the second slurry feeding apparatus are also attainable by the second method.

A third exemplary method according to the present invention is also adapted to feed polishing slurry to a chemical/mechanical polisher. The slurry stored in a container is stirred up by spraying the slurry from a position higher than the bottom of the container by a predetermined distance with a pressure applied from a pump to the slurry in recovering the slurry back to the container.

The same effects as those attained by the third slurry feeding apparatus are also attainable by the third method.

DESCRIPTION OF THE PREFERRED EMBODIMENTS

Figure 1:
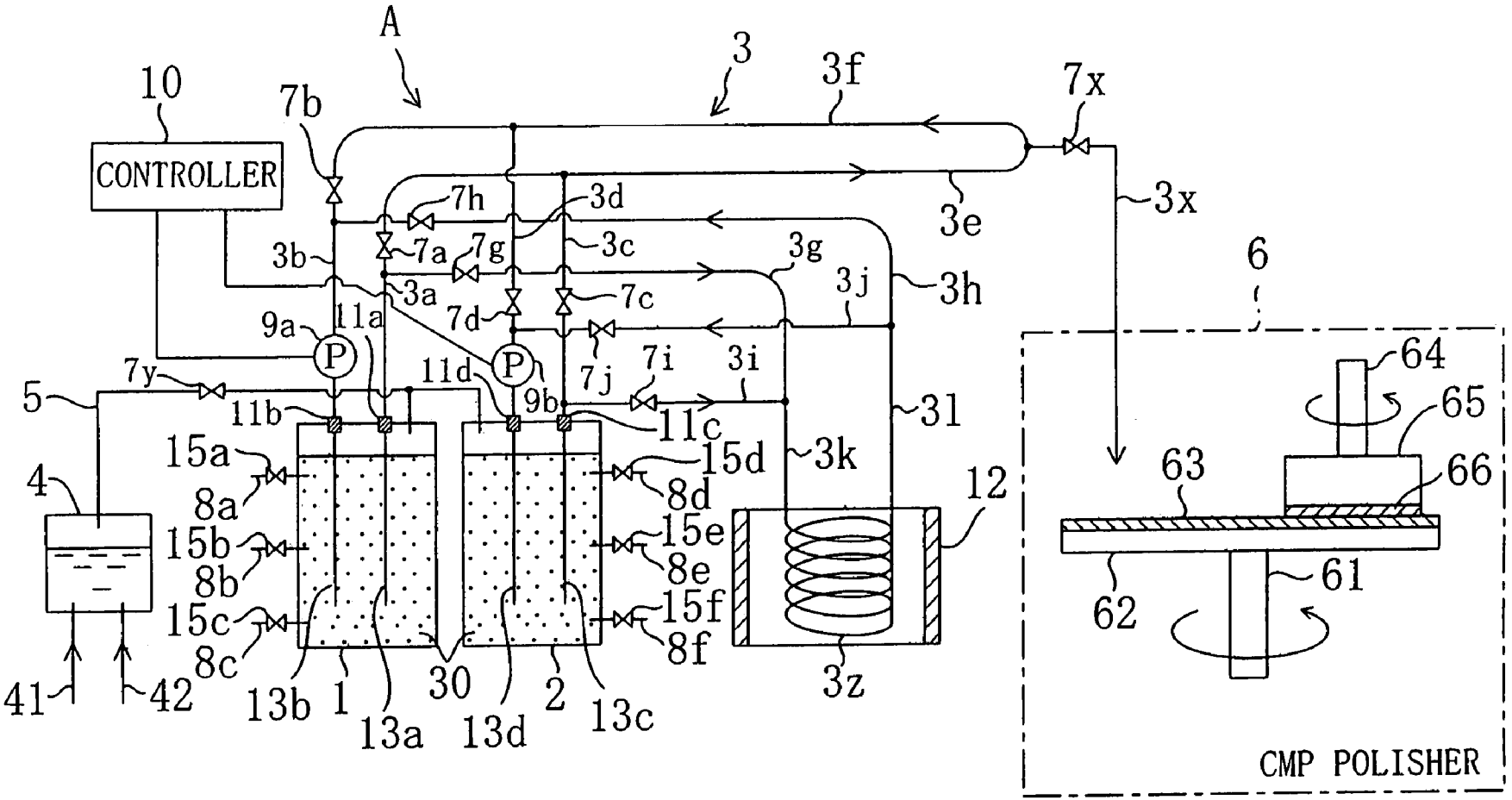
FIG. 1 schematically illustrates an arrangement of slurry feeding apparatus and CMP polisher according to an exemplary embodiment of the present invention.

FIG. 1 schematically illustrates an arrangement of slurry feeding apparatus A and CMP polisher 6 according to an exemplary embodiment of the present invention.

As shown in FIG. 1, the slurry feeding apparatus A includes two closed slurry bottles 1, 2, piping 3, wet nitrogen generator 4 and respective pipes 5, 41, 42. The piping 3 extends from the slurry bottles 1, 2 to the CMP polisher 6. The generator 4 generates humid nitrogen (or wet nitrogen) to be supplied to the bottles 1, 2 through the pipe 5. And nitrogen and pure water are supplied to the generator 4 through the pipes 41 and 42, respectively.

A pair of suction nozzles 13*a*, 13*c* for sucking the slurry 30 up from these bottles 1, 2 and delivering it through the piping 3 and a pair of spray nozzles 13*b*, 13*d* for recovering a spray of the slurry 30 to the bottles 1, 2 are inserted into the bottles 1, 2. Pipes 3*a*, 3*b*, 3*c* and 3*d* of the piping 3 extend from these nozzles 13*a*, 13*b*, 13*c* and 13*d*, respectively. Specifically, branched delivery pipes 3*a* and 3*c* are connected to the suction nozzles 13*a* and 13*c*, respectively, while branched recovery pipes 3*b* and 3*d* are connected to the spray nozzles 13*b* and 13*d*, respectively. The pair of branched delivery pipes 3*a* and 3*c* are coupled together to form a confluent delivery pipe 3*e*. The confluent delivery pipe 3*e* branches into: a slurry delivery pipe 3*x* reaching the CMP polisher 6; and a confluent recovery pipe 3*f*. The remaining part of the slurry 30, which has not flowed through the confluent delivery pipe 3*e* and then the slurry delivery pipe 3*x*, is recovered through the confluent recovery pipe 3*f*. That is to say, the branched recovery pipes 3*b* and 3*d* extend from the confluent recovery pipe 3*f* toward the slurry bottles 1 and 2, respectively.

The slurry feeding apparatus A further includes: an temperature regulator 12 with heater and cooler for regulating the temperature of the slurry 30; and a heat exchange coil 3*z* provided within the temperature regulator 12. Branched incoming pipes 3*g* and 3*i* extend from the branched delivery pipes 3*a* and 3*c*, respectively, to make the slurry 30 flow through the heat exchange coil 3*z*. These branched incoming pipes 3*g* and 3*i* are coupled together to form a confluent incoming pipe 3*k*, which is connected to the inlet port of the heat exchange coil 3*z*. A confluent outgoing pipe 3*l* extends from the outlet port of the heat exchange coil 3*z* and branches into branched outgoing pipes 3*h* and 3*j*, which are connected to the branched recovery pipes 3*b* and 3*d*, respectively.

These pipes 3*a*, 3*b*, 3*c*, 3*d*, 3*g*, 3*h*, 3*i*, 3*j*, 3*x* and 5 are provided with flow rate control valves 7*a*, 7*b*, 7*c*, 7*d*, 7*g*, 7*h*, 7*i*, 7*j*, 7*x* and 7*y*, respectively.

The branched recovery pipes 3*b* and 3*d* are provided with slurry recovery pumps 9*a* and 9*b* for spraying the slurry 30 back to the slurry bottles 1 and 2, respectively.

A controller 10 is further provided to control the operations and flow rates of the slurry recovery pumps 9*a* and 9*b*. While the CMP polisher 6 is performing chemical/mechanical polishing, the controller 10 continuously operates the slurry recovery pumps 9*a* and 9*b* such that the slurry 30 circulates continuously. On the other hand, while the CMP polisher 6 is idling, the controller 10 starts and stops the slurry recovery pumps 9*a* and 9*b* intermittently at regular time intervals. For example, while the CMP polisher 6 is idling, the controller 10 operates the slurry recovery pumps 9*a* and 9*b* for about five minutes per hour, thereby circulating the slurry 30.

To sample the slurry 30, the slurry bottles 1 and 2 are provided with two sets of sampling boards 8*a*, 8*b* and 8*c* and 8*d*, 8*e* and 8*f*, which are provided with valves 15*a*, 15*b* and 15*c* and 15*d*, 15*e* and 15*f*, respectively. That is to say, to examine the size distribution of abrasive grains in the slurry 30, the slurry 30 is ready to be extracted through the sampling boards 8*a*, 8*b* and 8*c* and 8*d*, 8*e* and 8*f* at the upper, intermediate and lower portions of the slurry bottles 1 and 2.

In addition, nozzle level adjusters 11*a*, 11*c*, 11*b* and 11*d* are further provided to adjust the levels of the suction and spray nozzles 13*a*, 13*c*, 13*b* and 13*d*, respectively.

On the other hand, the CMP polisher 6 includes polishing platen 62, lower drive shaft 61, polyurethane polishing pad 63, carrier 65 and upper drive shaft 64. The lower drive shaft 61 is provided to rotate the polishing platen 62. The polishing pad 63 is attached onto the polishing platen 62. The upper drive shaft 64 is provided to rotate the carrier 65 on which a wafer 66 to be polished is placed. And the slurry 30 is dripped onto the polishing pad 63 through a nozzle (not shown) at the end of the slurry delivery pipe 3*x*.

A schematic arrangement of the slurry feeding apparatus A according to the present invention is as described above. In the following description, characteristic members thereof will be detailed.

Stirring Method

According to the present invention, the slurry 30 is stirred up by spraying the slurry 30 through the spray nozzles 13*b* and 13*d* into the slurry bottles 1 and 2 as shown in FIG. 1, instead of providing stirrers such as propellers within the slurry bottles 1 and 2. This measure was adopted in view of the following results of experiments.

Figure 2A:
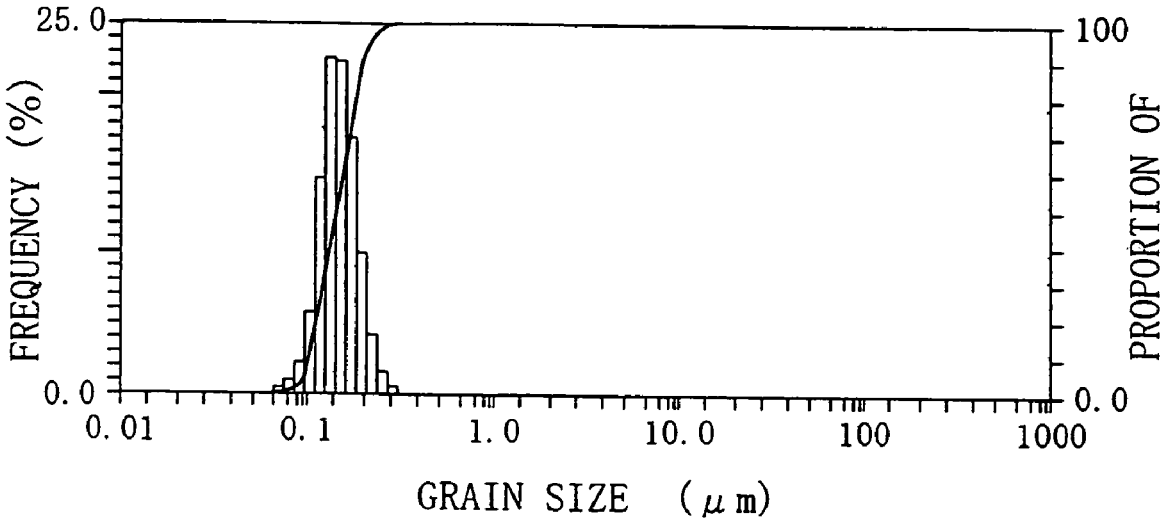
FIGS. 2(*a*) and 2(*b*) are graphs illustrating respective size distributions of abrasive grains before and after the grains have been stirred up with a propeller.
Figure 2B:
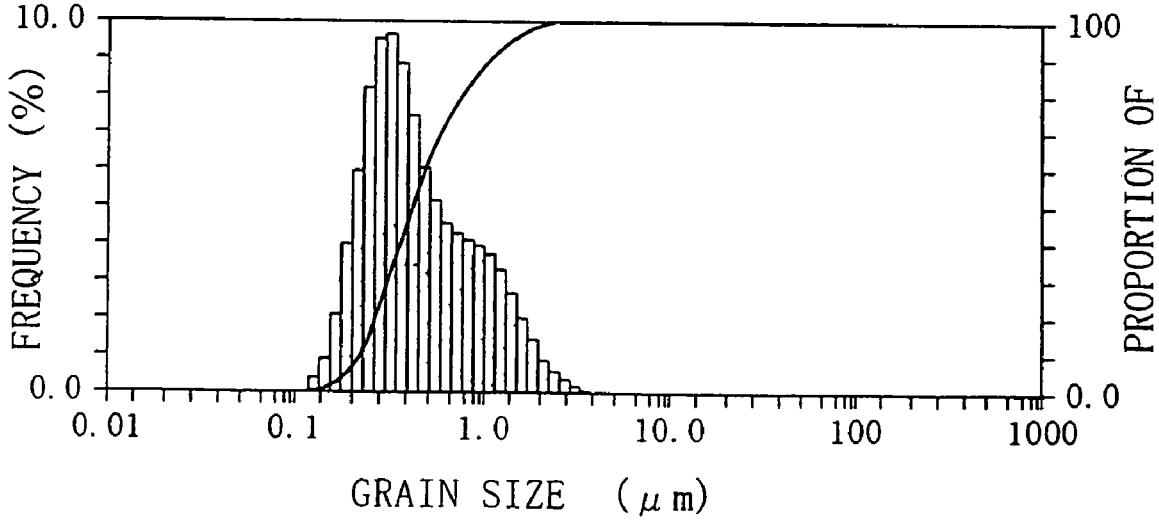

FIGS. 2(*a*) and 2(*b*) are graphs illustrating respective size distributions of abrasive grains before and after the grains have been stirred up with a propeller. As shown in FIG. 2(*a*), before the abrasive grains are stirred up with the propeller, the sizes of the grains are distributed within a range from 0.06 μm to 0.3 μm. In contrast, after the grains have been stirred up with the propeller, the sizes of the grains are distributed within a broader range from 0.06 μm to 4 μm as shown in FIG. 2(*b*). Thus, it can be seen that the number of abrasive grains with sizes of 500 nm or more has increased. The reason is believed to be as follows. When the abrasive grains collide against the propeller, the surface state of silica grains might change, e.g., the electrical structure thereof needed for maintaining the dispersion state of the abrasive grains might collapse. Accordingly, when energy is created locally around the propeller due to its rotation, abrasive grains are likely to collide against each other, thus coagulating and sedimenting an increasing number of abrasive grains.

Therefore, if the slurry 30 is stirred up by spraying the slurry 30 with circulation pressure applied by the pumps 9*a* and 9*b* as is done in this embodiment, then the coagulation of the slurry can be suppressed. In particular, since the levels of the spray nozzles 13*b* and 13*d* are adjustable using the nozzle level adjusters 11*b* and 11*d* according to this embodiment, the spray nozzles 13*b* and 13*d* can be located at such levels as attaining maximum stirring effect on the slurry 30 within the slurry bottles 1 and 2.

In the example illustrated in FIG. 1, only one spray nozzle 13*b*, 13*d* is provided for each slurry bottle 1, 2. A plurality of spray nozzles may be provided for a single bottle if necessary to enhance the stirring effects.

Also, to attain enhanced stirring effects, the spray nozzles 13*b* and 13*d* are preferably located at respective levels higher than the bottom of the slurry bottles 1, 2 by 5 centimeters or less.

Furthermore, if the end of the spray nozzles 13*b* and 13*d* has an opening with a reduced diameter, the velocity of the slurry 30 sprayed can be increased, thus enhancing the stirring effect.

Intermittent Operation

Even if the slurry 30 is stirred up by spraying the slurry 30 with a pressure applied from the pumps 9*a* and 9*b* as is done in this embodiment, however, a certain amount of slurry may be coagulated. This is because no matter whether t h e wafer is being polished by the CMP polisher 6 or not (i.e., while the polisher 6 is idling), the abrasive grains could collide against each other due to the circulation pressure applied from the pumps 9*a* and 9*b*. As a result, the electrical structure thereof needed for maintaining the dispersion state of the abrasive grains might collapse, thus possibly coagulating the grains. Nevertheless, if the slurry is not stirred up at all, then the slurry will be sedimented within the slurry bottles 1 and 2. As a result, the solid content concentration of the slurry becomes non-uniform and it is impossible to polish the wafer uniformly anymore. This-phenomenon usually appears in 48 to 72 hours, which is variable depending on the type of the slurry used. Accordingly, if the slurry is not stirred up at all while the polisher is idling, then the slurry 30 must be replaced in every 48 to 72 hours, thus creating inconvenience during the polishing process.

To solve such a problem, the controller 10 operates the pumps 9*a* and 9 intermittently according to this embodiment. That is to say, while the CMP polisher 6 is polishing the wafer, the controller 10 continuously operates the pumps 9*a* and 9*b*, thereby always circulating, spraying and stirring the slurry 30. While the polisher 6 is idling on the other hand, the controller 10 operates the pumps 9*a* and 9*b* just intermittently to circulate and stir up the slurry 30 at regular intervals. Specifically, while the polisher 6 is idling, the controller 10 operates the pumps 9*a* and 9*b* for just about five minutes per hour.

Figure 3:
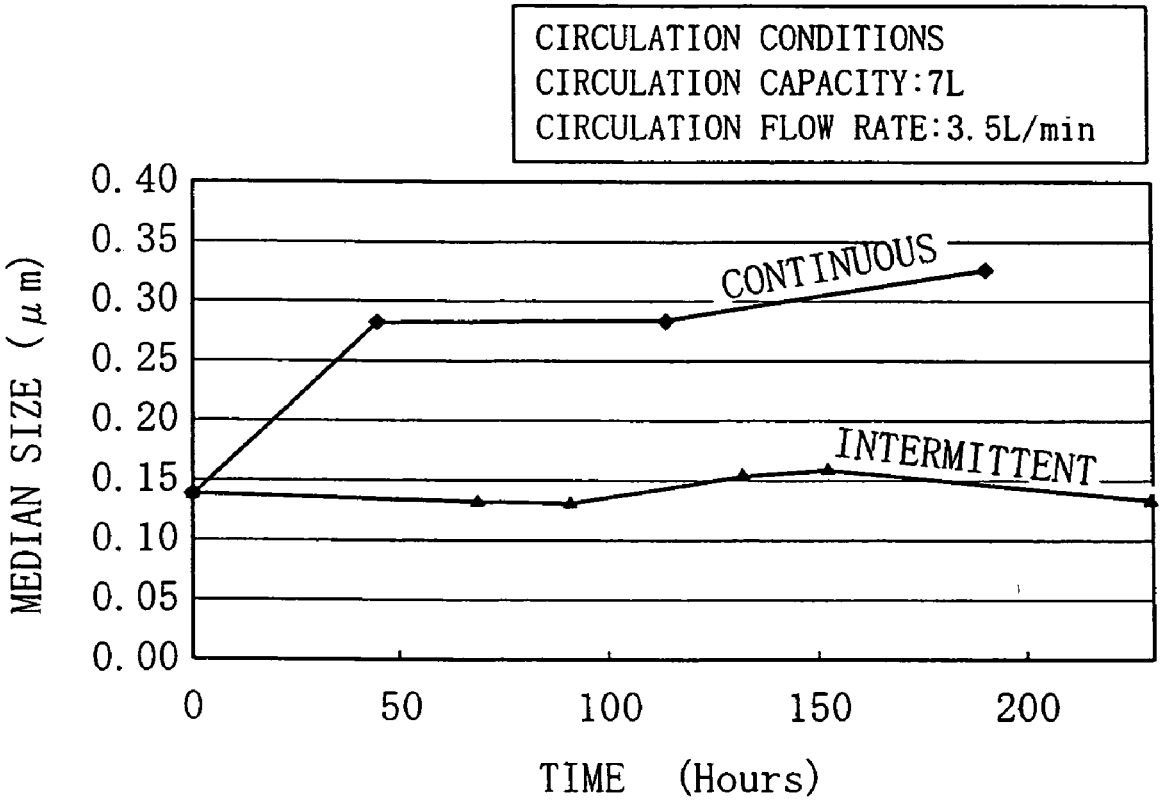
FIG. 3 is a graph illustrating variations in the median size of abrasive grains with a period of time for which pumps are operated either continuously or intermittently while the polisher is idling.

FIG. 3 illustrates data about variations in the median size of abrasive grains with a period of time for which the pumps 9*a* and 9*b* are operated either continuously or intermittently while the polisher 6 is idling. As shown in FIG. 3, if the pumps 9*a* and 9*b* are operated continuously, then the median size soon reaches around 0.3 μm. In contrast, if the pumps 9*a* and 9*b* are operated intermittently, then the median size is kept at approximately 0.15 μm.

By intermittently operating the slurry-circulating pumps 9*a* and 9*b* in this manner while the polisher is idling, it is possible to effectively prevent the abrasive grains from increasing their grain sizes. This method is based on an idea that the slurry 30 should be circulated for as long a time as needed if the lifetime of the slurry 30 depends on the number of abrasive grains of excessively increased sizes and how long the slurry 30 is circulated.

The following Table 1 illustrates, in comparison, the numbers of excessively large grains (with sizes of 500 nm or more) contained in each 30 μl of the slurry extracted from the upper, intermediate and lower portions of the slurry bottle, respectively, and the numbers of micro-scratches made on the wafer being polished using the slurry at these portions in accordance with the conventional and inventive stirring methods.

TABLE 1

| | Conventional stirring | | Inventive stirring | |
|---|---|---|---|---|
| Portion of Bottle | Number of Large grains | Number of Microscratches | Number of Large grains | Number of Microscratches |
| Upper | 3,590 | 23 | 44,155 | 13 |
| Interme-diate | 115,777 | 25 | 48,368 | 25 |
| Lower | 368,141 | 348 | 47,135 | 20 |

As can be seen from Table 1, according to the conventional stirring method, the number of excessively large grains is relatively small in the slurry extracted from the upper portion of the bottle. But the numbers of excessively large grains are very large in the slurry extracted from the intermediate and lower portions thereof. Thus, the grains are distributed non-uniformly within the bottle according to the conventional method. In contrast, according to the inventive stirring method, the total number of excessively large grains is much smaller in the slurry extracted from the upper, intermediate and lower portions of the bottle. Also, it can be seen that those numbers are averaged no matter which portion the slurry is extracted from.

Nozzle Level

Figure 4:
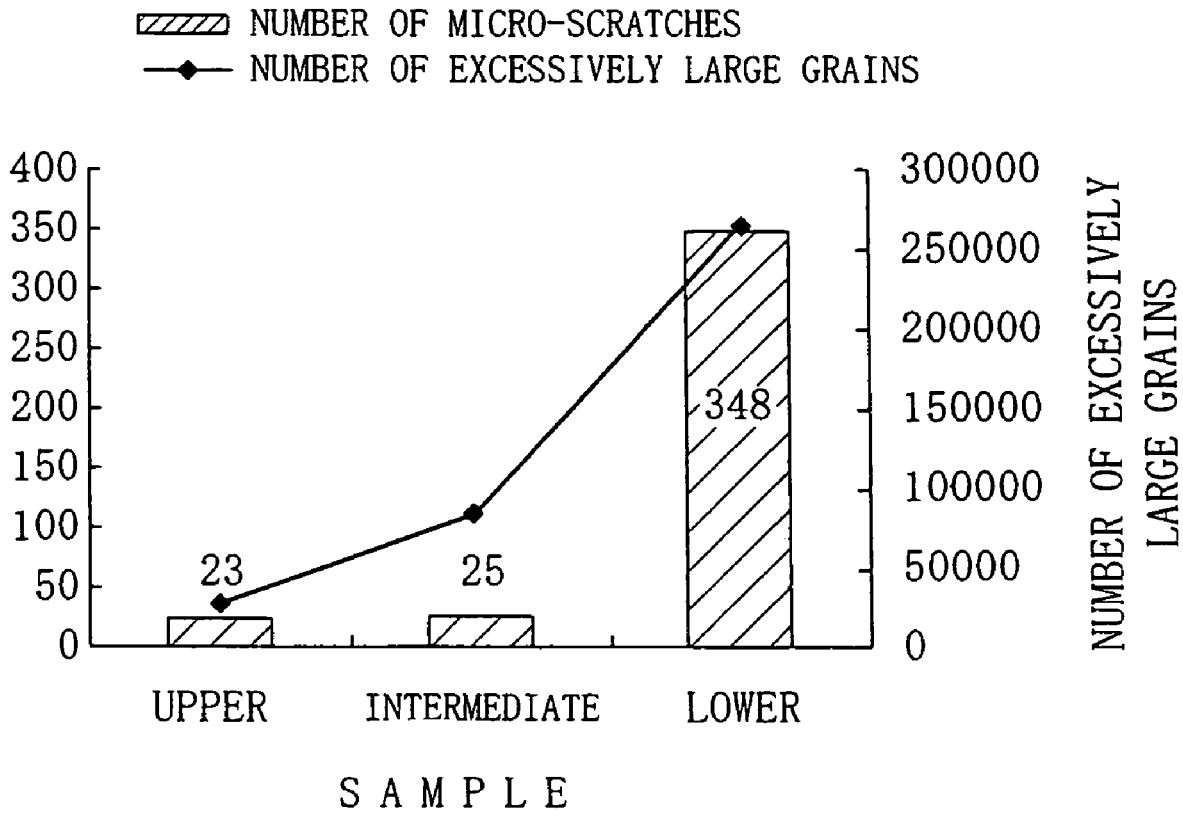
FIG. 4 is a graph illustrating correlation between respective numbers of excessively large grains extracted from the upper, intermediate and lower portions of a conventional slurry bottle and respective numbers of micro-scratches.

FIG. 4 is a graphic representation of the data shown in Table 1. As shown in FIG. 4, there are an outstanding number of excessively large grains in the slurry deposited on the bottom of the bottle according to the conventional method. Thus, the number of micro-scratches resulting from a chemical/mechanical polishing process using such slurry is also remarkably high correspondingly.

Figure 5:
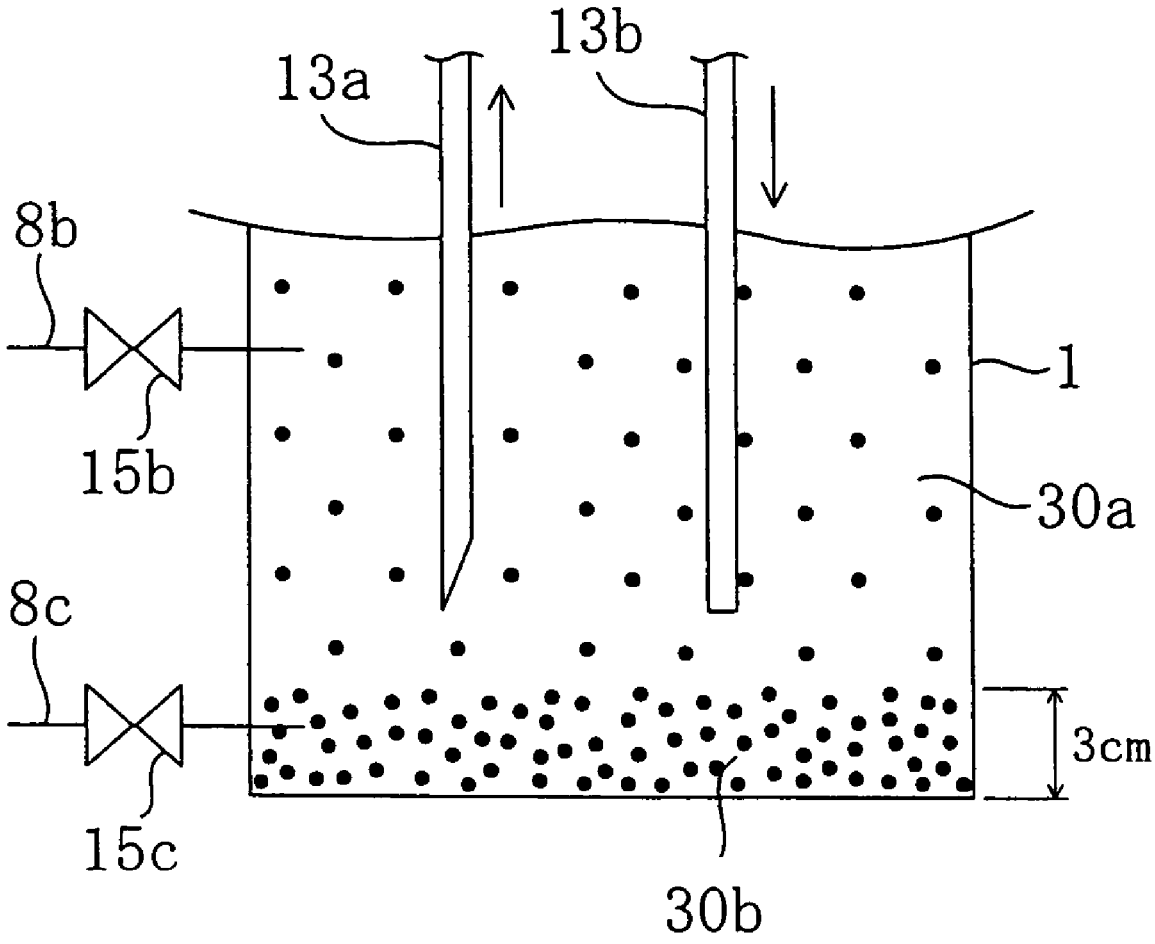
FIG. 5 is a cross-sectional view illustrating the shapes of slurry bottle, suction and spray nozzles and a positional relationship among them according to the present invention.

FIG. 5 illustrates a detailed cross-sectional structure of the slurry bottle 1 and nozzles 13*a* and 13*b* according to the present invention. It should be noted that the other slurry bottle 2 and nozzles 13*c* and 13*d* shown in FIG. 1 have the same structure.

According to this embodiment, since the slurry is not stirred up with the propeller, almost no excessively large grains are deposited on the bottom of the slurry bottle 1, 2. However, coagulated silica grains may have been mixed or the abrasive grains may have been sedimented in the slurry 30 before the slurry 30 is stirred up.

Thus, according to this embodiment, part of the slurry 30 located in the lower portion of the bottle 1, 2, where those excessively large abrasive grains may have been sedimented, are not sucked up according to this embodiment as shown in FIG. 5. For example, part 30*a* of the slurry 30 located 3 centimeter or more higher the bottom of the bottle 1, 2 may contain almost no excessively large abrasive grains, whereas the remaining part 30*b* of the slurry 30 located less than 3 centimeter higher than the bottom of the bottle 1, 2 may contain a lot of excessively large abrasive grains. Thus, if that part of the slurry 30 less than 5 centimeter higher than the bottom of the bottle 1, 2 is not sucked up, then it is rather probable to prevent the excessively large abrasive grains from being delivered to the CMP polisher.

Also, this effect is enhanced by getting the levels of the suction nozzles 13*a* and 13*c* adjusted by the nozzle level adjusters 11*a* and 11*b* shown in FIG. 1.

Nozzle Shape

As shown in FIG. 5, the end of the suction nozzle 13*a* has an ellipsoidal cross-sectional shape and has been cut away obliquely with respect to the axis thereof. On the other hand, the end of the spray nozzle 13*b* has a normal circular cross-sectional shape and has been cut away vertically with respect to the axis thereof.

Figure 6A:
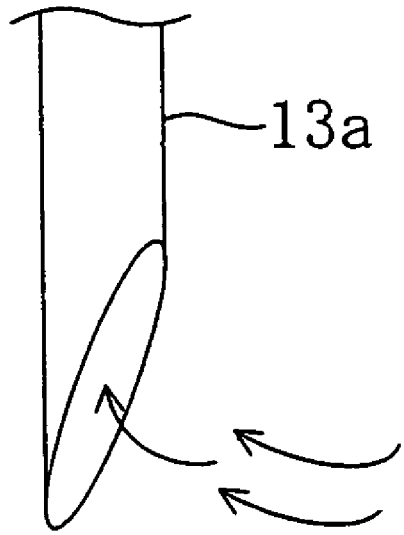
FIGS. 6(*a*) and 6(*b*) illustrate a difference in shape and suction region between the suction nozzle according to the present invention and the conventional suction nozzle at respective ends thereof.
Figure 6B:
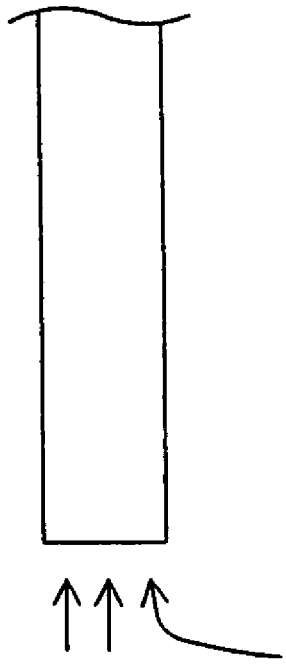

FIGS. 6(*a*) and 6(*b*) illustrate a difference in shape and suction region between the suction nozzle 13*a* according to the present invention and the conventional suction nozzle at respective ends thereof. As shown in FIG. 6(*b*), the conventional suction nozzle with its end cut away vertically with respect to the axis thereof is likely to suck the slurry up from the vicinity of the bottom of the bottle. Accordingly, the excessively large grains, which are apt to remain deposited on the bottom of the slurry bottle, is also likely to be sucked up and delivered to the CMP polisher. As a result, an increased number of micro-scratches are made on the object being polished or the polishing rate adversely decreases. In contrast, since the suction nozzle 13*a* according to the present invention has its end cut away obliquely as shown in FIG. 6(*a*), it is possible to prevent the excessively large grains, which are apt to remain deposited on the bottom of the slurry bottle 1, from being sucked up. As a result, the number of micro-scratches made on the object being polished (i.e., the wafer 66) can be reduced and the decrease in polishing rate can be suppressed.

Alternatively, the end of the suction nozzle 13*a*, 13*c* may be closed and provided with a plurality of openings around the circumference thereof to suck the slurry 30 up therethrough. Similar effects are also attainable in such an embodiment.

Coupling Structure Between Pipes

According to this embodiment, no coupling is provided for the joint portion of the piping 3 shown in FIG. 1. Instead, the pipes are welded together according to the present invention. The confluent pipe and associated branched pipes or the bottle and associated pipes are also welded together. Furthermore, a corner of each pipe is curved with a radius of curvature of 5 centimeters or more, thereby eliminating puddles of the slurry 30.

By adopting such a piping structure, the level differences or gaps, which are involved with conventional couplings for linear or curvilinear portions of the slurry delivery pipes, can be eliminated. In addition, it is also possible to prevent excessively large abrasive grains from being formed due to the slurry puddles.

Slurry Temperature Control

Figure 7:
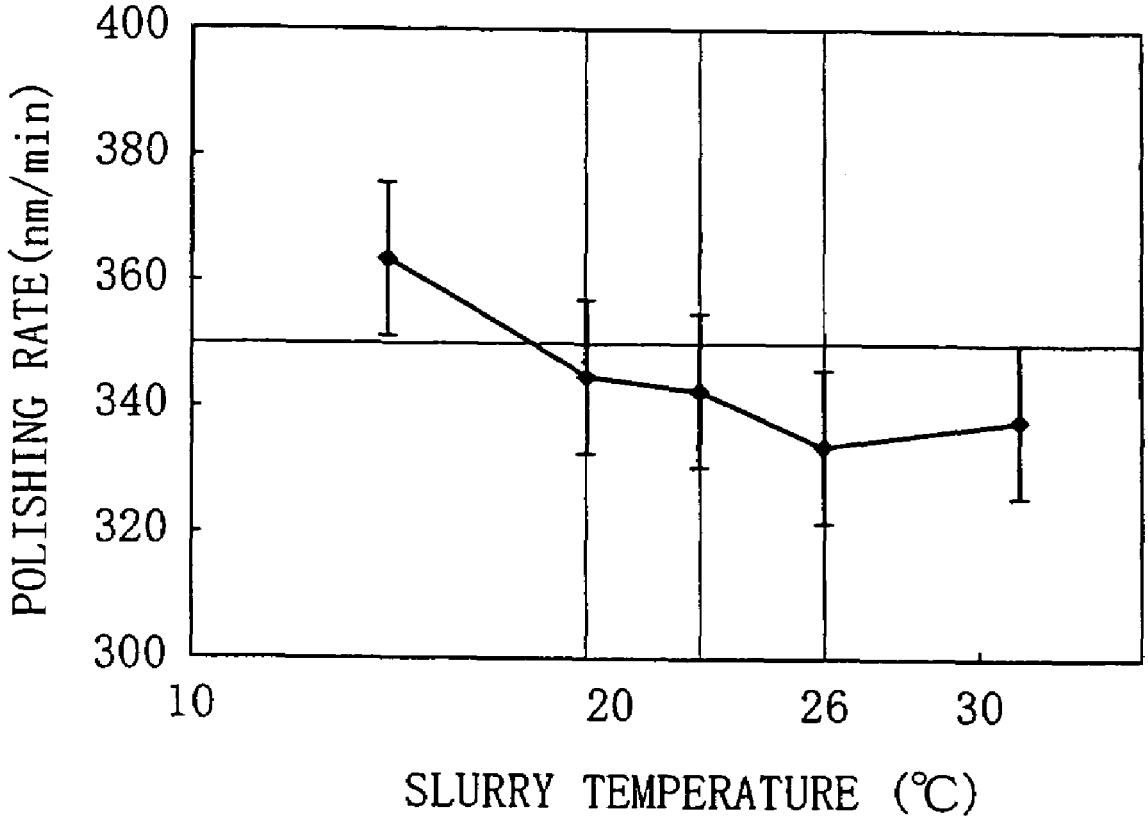
FIG. 7 is a graph illustrating the dependence of a wafer polishing rate on the temperature of the slurry.
Figure 8:
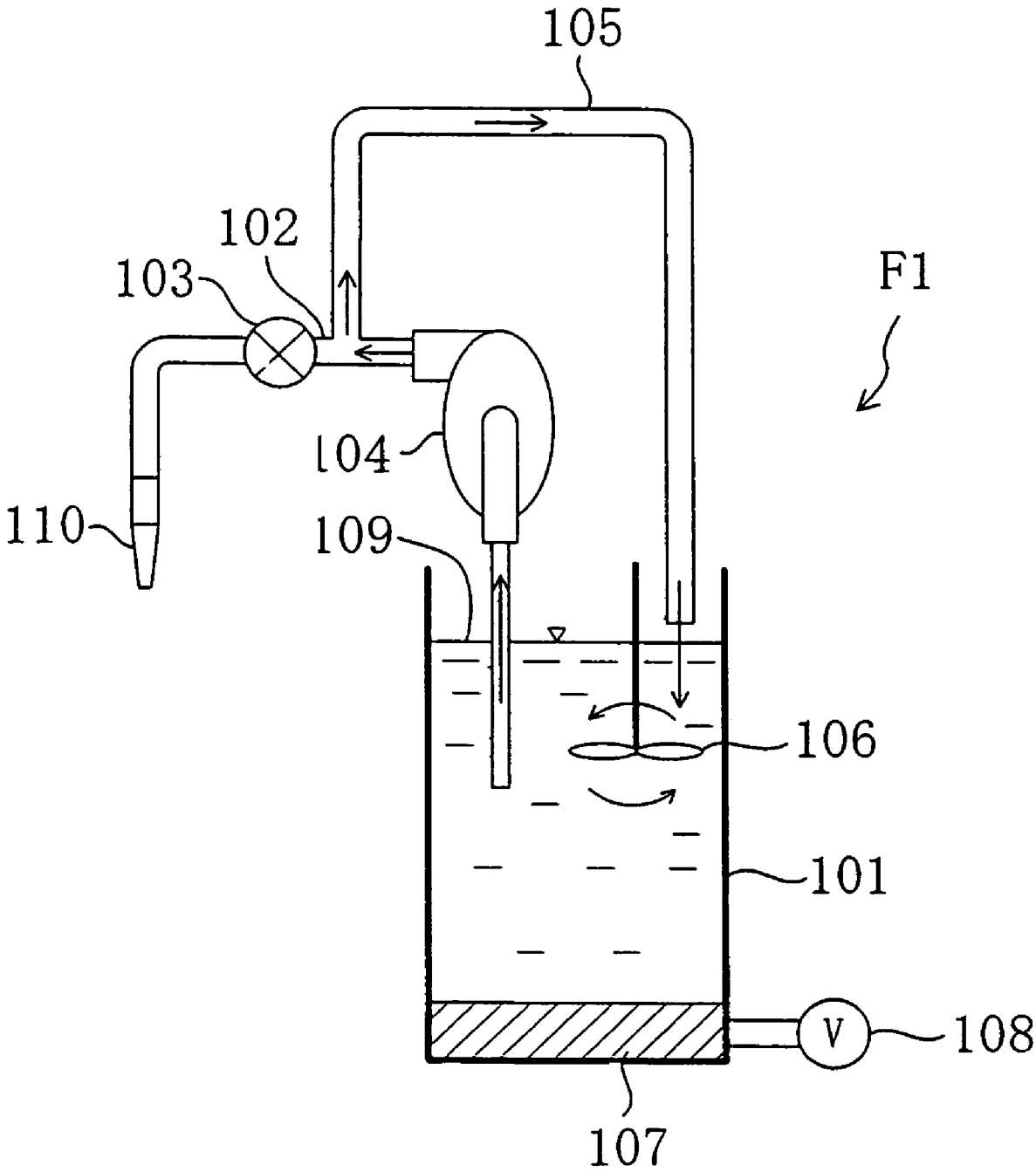
Fig. 8 PRIOR ART
FIG. 8 is a cross-sectional view illustrating an arrangement of a conventional slurry feeding apparatus.
Figure 9:
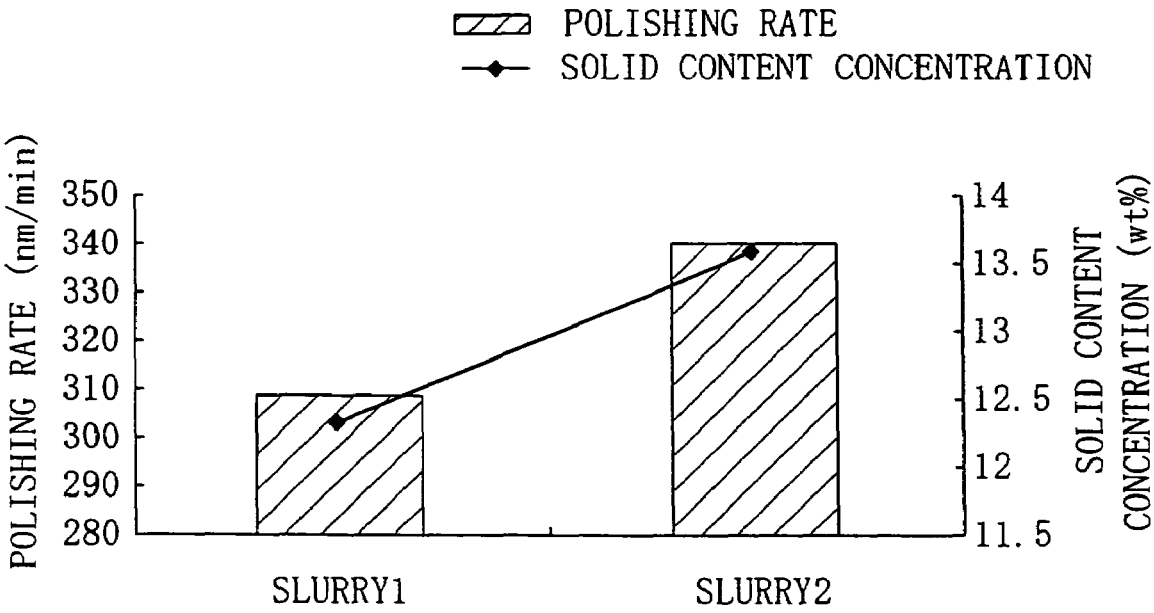
FIG. 9 is a graph illustrating, in comparison, respective polishing rates of Slurry 1 and 2 with mutually different solid content concentrations in accordance with results of experiments carried out by the present inventors.
Figure 10:
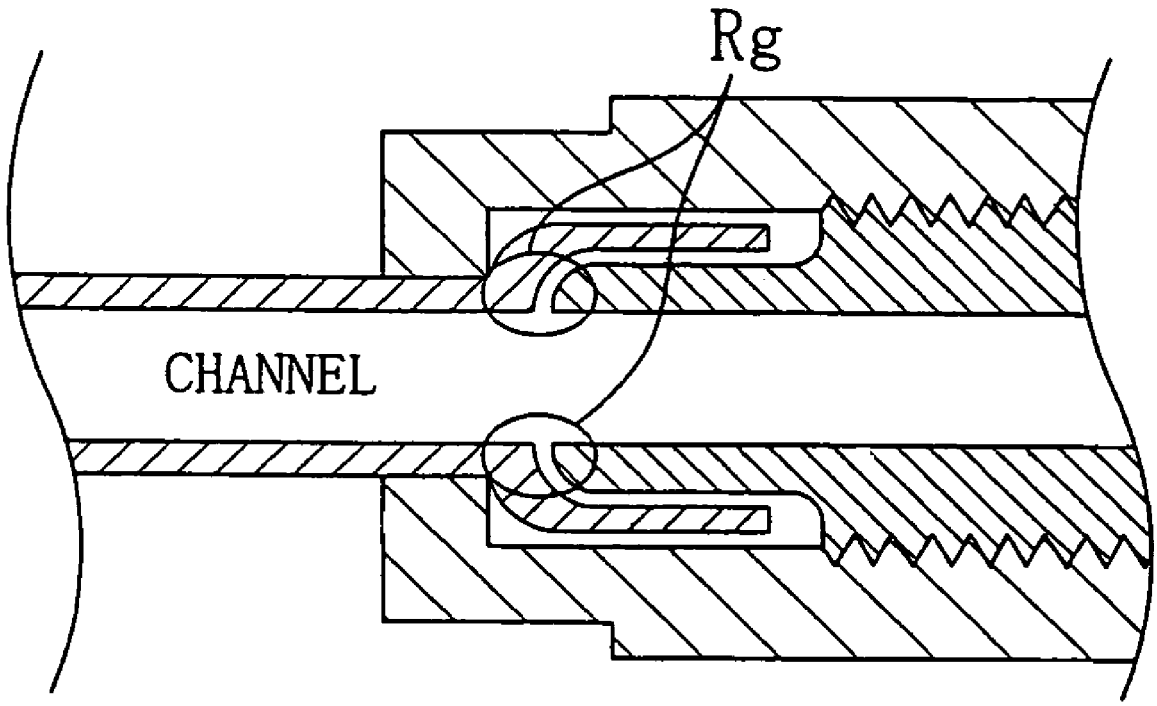
FIG. 10 is a cross-sectional view of a coupling generally provided for a slurry delivery pipe in a conventional slurry feeding apparatus.

FIG. 7 is a graph illustrating the dependence of the polishing rate of a wafer on the temperature of slurry. As shown in FIG. 7, as the slurry temperature rises, the polishing rate tends to decrease. However, while the slurry temperature is in the range from 20° C. to 26° C., the variation (or decrease) in polishing rate is gentler. Thus, according to this embodiment, the polishing rate can be stabilized by getting the temperature of part of the slurry 30, which has been diverted from its circulation path, controlled by the temperature regulator 12 shown in FIG. 1.

Slurry Bottle Structure

In the slurry feeding apparatus according to the present invention, the slurry bottles 1 and 2 are hermetically sealed and filled in with wet nitrogen. Thus, it is possible to suppress the solidification of the slurry within these bottles 1 and 2. That is to say, the humidity within the slurry bottles 1 and 2 is kept as high as 95% or more by $NH_4OH$ vaporized or wet nitrogen. Accordingly, even if the slurry 30 within these bottles 1 and 2 has changed its level, almost no solidified slurry is deposited on the inner walls of the slurry bottles 1 and 2.

Sampling Boards Attached

In addition, the slurry bottles 1 and 2 are provided with the two sets of sampling boards 8*a*, 8*b* and 8*c* and 8*d*, 8*e* and 8*f* to see if there is any change in the state of the slurry 30. Thus, it is possible to expect exactly when the lifetime of the slurry 30 would come to an end. Also, appropriate measures can be taken should any abnormality happen. Furthermore, a state that is going to cause such abnormality can be detected beforehand to prevent the generation thereof. As a result, chemical/mechanical polishing can be performed constantly.

In an ordinary semiconductor device manufacturing process, as well as in the foregoing embodiment, silica grains are used as abrasive grains. However, the present invention is in no way limited to the semiconductor device manufacturing process and any appropriate polishing material other than silica is naturally usable according to the present invention. That is to say, the present invention is applicable to preventing the size of abrasive grains from being increased excessively due to coagulation of the grains contained in some slurry-like polishing material. Specifically, the present invention can be taken advantage of in producing a semiconductor wafer from semiconductor crystals, making a wafer of any other material, performing chemical/mechanical polishing during the fabrication process of any device other than a semiconductor device and conducting any polishing other than chemical/mechanical polishing. Examples of polishing materials other than silica include cerium oxide, alumina and manganese oxide.

What is claimed is:

1. A slurry feeding apparatus for feeding polishing slurry to a chemical/mechanical polisher, the apparatus comprising:

a container for storing the slurry therein, a first nozzle for sucking the slurry up from the container;

a second nozzle for spraying the slurry into the container;

a third nozzle for dripping the slurry in the polisher;

a first pipe, which is connected to the first and third nozzles for delivering the slurry to the polisher;

a second pipe, which is connected to the second nozzle and the first pipe for bypassing at least part of the slurry flowing through the first pipe from the third nozzle and then recovering that part of the slurry back to the second nozzle;

a control valve for regulating the flow rate of the slurry, which is flowing through the first pipe and supplied to the third nozzle and the second pipe; and a pump, provided for at least one of the first pipe and the second pipe for making the slurry flow under pressure, wherein the second nozzle sprays the slurry into the container from a position that is set to be no less than a predetermined level from a bottom of the container and no more than a solution level of the slurry to stir the slurry.

2. The apparatus of claim 1, wherein the second nozzle sprays the slurry into the container from a position higher than the bottom of the container by 5 centimeters or less.

3. The apparatus of claim 1, wherein the second nozzle has an opening with a reduced diameter at the end thereof.

4. The apparatus of claim 1, further comprising a mechanism for adjusting the level of the second nozzle at the end thereof.

5. The apparatus of claim 1, wherein a plurality of the second nozzles are placed within the container.

6. A polishing process, wherein the slurry is fed from the slurry feeding apparatus of claim 1 to the chemical/mechanical polisher and an object to be polished is polished by the chemical/mechanical polisher.

* * * * *